US005299697A

United States Patent [19]

Ho et al.

[11] Patent Number: 5,299,697

[45] Date of Patent: Apr. 5, 1994

[54] CONCEALABLE ROTARY STAND FOR HANGING CLOTHES

[76] Inventors: Chiu C. Ho; Lin F. Cheng; Lin T. Fu, all of No. 48, Tafeng st., Panchiao City, Taipei Hsien, Taiwan

[21] Appl. No.: 965,348

[22] Filed: Oct. 23, 1992

[51] Int. Cl.[5] ..... A47F 5/00

[52] U.S. Cl. ..... 211/163; 312/135

[58] Field of Search ..... 211/163, 205, 95, 168; 312/135, 123, 125, 249.2

[56] References Cited

U.S. PATENT DOCUMENTS

| | | | |
|---|---|---|---|
| 819,432 | 5/1906 | Jaeger | 312/135 X |
| 1,134,908 | 4/1915 | Romsos | 312/135 |
| 1,258,276 | 3/1918 | Turcek | 312/135 |
| 1,933,203 | 10/1933 | Azwell | 211/163 X |
| 4,351,458 | 9/1982 | Wolfe | 211/163 X |
| 4,418,970 | 12/1983 | Hyder et al. | 312/135 X |
| 4,531,645 | 7/1985 | Tisbo et al. | 312/125 X |

*Primary Examiner*—Robert W. Gibson, Jr.
*Attorney, Agent, or Firm*—Ladas & Parry

[57] ABSTRACT

A concealable rotary stand for hanging clothes. The stand includes a round top supported on a rotary table above a bottom plate by an upright post with pegs, and a shield peripherally covered between the round top and the rotary table and spaced around the upright post. The shield has an opening for access, which may be turned toward the wall and concealed from the sight.

6 Claims, 2 Drawing Sheets

CONCEALABLE ROTARY STAND FOR HANGING CLOTHES

BACKGROUND OF THE INVENTION

The present invention relates to a stand and relates more particularly to a concealable rotary stand for hanging clothes.

Various clothes trees are known and widely used for hanging clothes and hats. These clothes trees may be different in shape; however, they commonly comprise an upright post-like stand with pegs or hooks around the top on which to hang clothes. Because these clothes trees do not have any shielding means to protect the clothes, the clothes may be covered with dirt easily. Furthermore, the disorderly hanging of clothes on a clothes tree may destroy the sense of beauty of the environment.

SUMMARY OF THE INVENTION

The present invention has been accomplished under the aforesaid circumstances. According to one aspect of the present invention, the concealable rotary stand has a shield covered around an upright post with pegs thereof for protecting clothes against dirt. According to another aspect of the present invention, the shield is connected between a round top and a rotary table on a bottom plate and spaced around the upright post. Therefore, the shield can be rotated on the bottom plate for permitting an opening on the shield to be turned toward the user for access or turned away from the sight.

DETAILED DESCRIPTION OF THE PREFERRED EMBODIMENT

Figure 1:
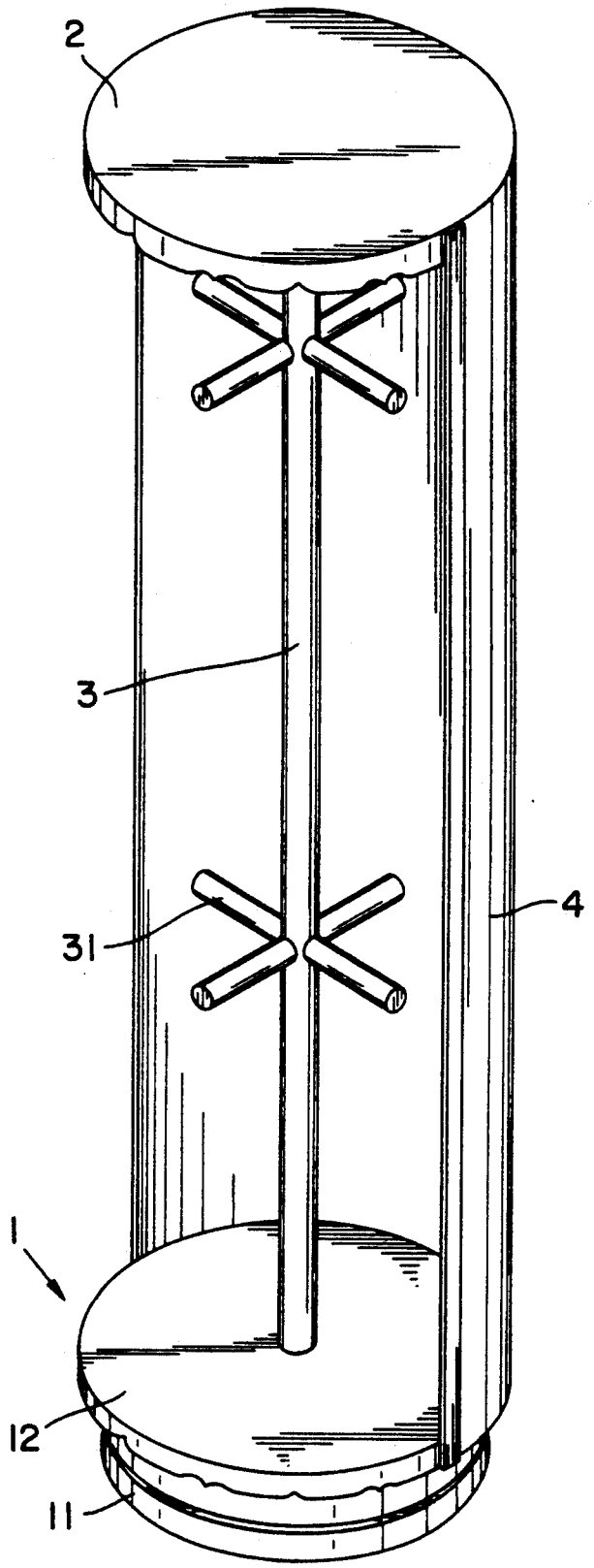
FIG. 1 is an elevational view of a concealable rotary stand embodying the present invention.
Figure 2:
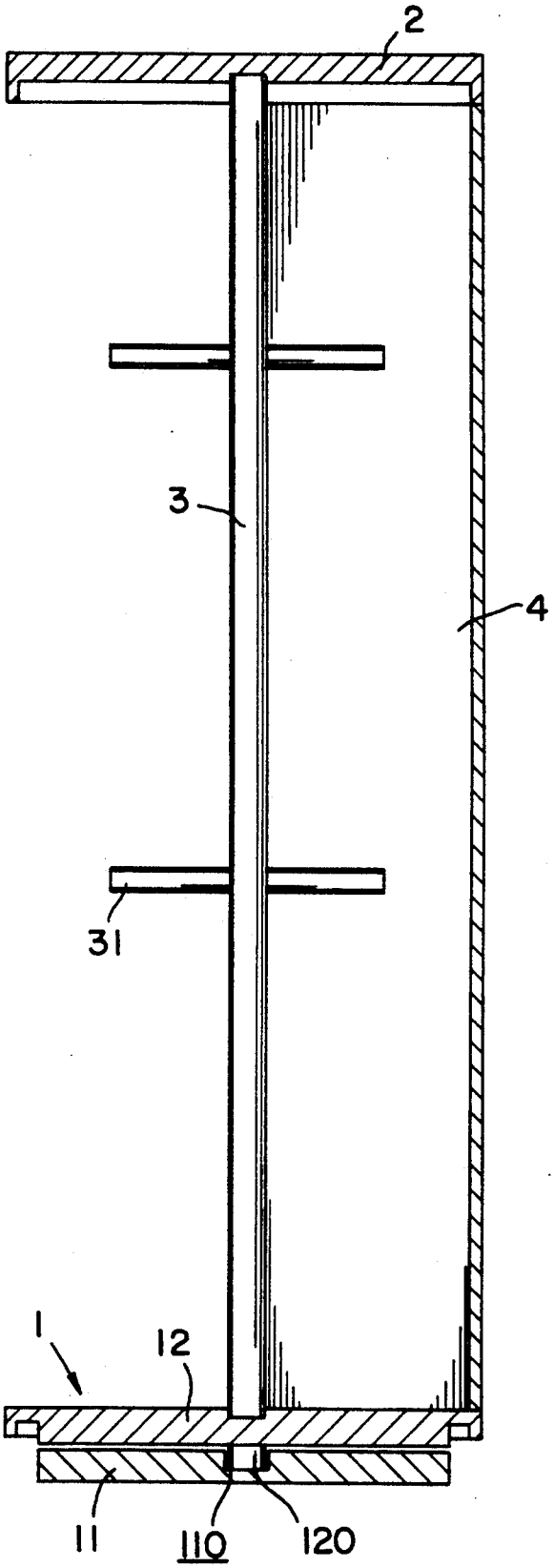
FIG. 2 is a plan sectional view thereof in longitudinal direction.

Referring to FIGS. 1 and 2, a concealable rotary stand as constructed in accordance with the present invention is generally comprised of a round base 1, a round top 2 supported on the round base 1 by an upright post 3, and a shield 4 peripherally covered between the round base 1 and the round top 2 and spaced around the upright post 3. The base 1 comprises a bottom plate 11 having an axle bush 110 fastened in a recessed center hole (not shown) thereon, and a rotary table 12 coupled to the upright post 3 at the bottom and having a bottom shaft 120 revolvably fitted into the axle bush 110 on the bottom plate 11. Therefore, rotating the upright post 3 causes the rotary table 12 to be rotated on the bottom plate 11. The upright post 3 has pegs 31 around the top periphery thereof at different heights for hanging clothes and hats. The shield 4 is connected between the round base 1 and the round top 2 around the upright post 3 with an opening left for access. The shield 4 may be made of any of a variety of materials and printed or embossed with decorative patterns. The stand may be placed on one corner inside a room with the opening on the shield 4 turned toward the wall and concealed from the sight. Turning the shield 4 causes the rotary table 12 to be rotated on the bottom plate 11 for permitting the opening on the shield 4 to be moved to the outside for hanging clothes on the pegs or removing clothes from the pegs.

What is claimed is:

1. A rotary stand comprising only:

a circular base having a rotary table revolvably supported on a bottom plate;

an upright post extending from said base and comprised of hanging means extending from the length of said post;

a circular top supported on said post opposite said base; and a shield extending between said base and said top to partially encircle said upright post and thereby define an opening for accessing said post, said shield being connected at least to said base such that upon rotation of said base, said shield also rotates thereby making possible the repositioning of said opening.

2. A hanging means comprised of:

a top;

a rotatable bottom located opposite from said top;

a hanging post and extending between said bottom and said top, said hanging post being located interior of the outside edges of said top and said bottom;

a shield connected to at least said bottom, and extending between said bottom and said top and exterior of said post, said shield being at least in line with the outside edges of said top and said bottom and partially surrounding and being spaced from said post to thereby leave an open area between said top and said bottom to access said post, whereupon rotation of said bottom said shield is also rotated thus repositioning said open area during said rotation.

3. The hanging means of claim 2 wherein said top and said bottom are each solid, and whereby said post includes pegs, such that items may be hung from said pegs.

4. The hanging means of claim 3 wherein said bottom is comprised of a base plate and a table on top of said base plate, said table being rotatably situated with respect to said base plate.

5. The hanging means of claim 4 wherein said post is meant for hanging clothes thereon.

6. A hanging means comprised of:

a top;

a rotatable bottom located opposite from said top;

a hanging post and extending between said bottom and said top, said hanging post being located interior of the outside edges of said top and said bottom;

a shield connected to at least said bottom, and extending between said bottom and said top and exterior of said post, said shield only partially surrounding and being spaced from said post to thereby leave an open area to access said post, whereupon rotation of said bottom, said shield is also rotated thus repositioning said open area during said rotation.

* * * * *